US008280283B2

(12) United States Patent
Ogiyama et al.

(10) Patent No.: US 8,280,283 B2
(45) Date of Patent: Oct. 2, 2012

(54) HEAT TRANSMISSION MEMBER INCLUDED IMAGE FORMING APPARATUS

(75) Inventors: Hiromi Ogiyama, Tokyo (JP); Ken Yoshida, Chigasaki (JP)

(73) Assignee: Ricoh Company, Limited, Tokyo (JP)

( * ) Notice: Subject to any disclaimer, the term of this patent is extended or adjusted under 35 U.S.C. 154(b) by 413 days.

(21) Appl. No.: 12/568,959

(22) Filed: Sep. 29, 2009

(65) Prior Publication Data

US 2010/0080631 A1 Apr. 1, 2010

(30) Foreign Application Priority Data

Oct. 1, 2008 (JP) ..... 2008-255871
Dec. 15, 2008 (JP) ..... 2008-318690
Jun. 1, 2009 (JP) ..... 2009-131729

(51) Int. Cl.
*G03G 15/00* (2006.01)
*G03G 15/01* (2006.01)
*G03G 15/20* (2006.01)
*G03G 21/20* (2006.01)

(52) U.S. Cl. ..... 399/302; 399/94; 399/107; 399/308

(58) Field of Classification Search ..... 399/44, 399/94, 96, 302
See application file for complete search history.

(56) References Cited

U.S. PATENT DOCUMENTS 5,897,247 A * 4/1999 Tombs et al. ..... 399/308
6,259,880 B1 * 7/2001 Jia et al. ..... 399/307
6,405,002 B2 6/2002 Ogiyama et al.
6,901,234 B2 5/2005 Ogiyama et al.
7,003,238 B2 2/2006 Sawai et al.
7,346,287 B2 3/2008 Ogiyama et al.
7,546,076 B2 * 6/2009 Fuchiwaki et al. ..... 399/316
2003/0118359 A1 6/2003 Ogiyama et al.
2006/0045551 A1 * 3/2006 Itagaki ..... 399/45
2006/0098999 A1 * 5/2006 Nishida et al. ..... 399/55
2006/0127144 A1 * 6/2006 Watanabe ..... 399/329
2007/0147920 A1 * 6/2007 Shimizu ..... 399/400
2007/0258737 A1 11/2007 Ogiyama et al.
2009/0067895 A1 * 3/2009 Tominaga ..... 399/308
2009/0068582 A1 * 3/2009 Kawaguchi ..... 430/109.4
2009/0087772 A1 * 4/2009 Kawaguchi et al. ..... 430/111.4

FOREIGN PATENT DOCUMENTS

JP 3-288174 12/1991
JP 5-289537 11/1993
JP 9-96971 4/1997
JP 2004-184875 7/2004
JP 2004325625 A * 11/2004

OTHER PUBLICATIONS

Machine translation of JP 2004325625.*
Machine translation of JP 2004184875.*

* cited by examiner

*Primary Examiner* — Walter L Lindsay, Jr.
*Assistant Examiner* — David Bolduc
(74) *Attorney, Agent, or Firm* — Oblon, Spivak, McClelland, Maier & Neustadt, L.L.P.

(57) ABSTRACT

An image forming apparatus for transferring and superimposing toner images formed on plural image bearers onto an endless intermediate transfer member in an electric field created between the plural image bearers and plural semi conductive transfer members internally contacting the endless intermediate transfer member. The image forming apparatus includes a heat generating member arranged inside the intermediate transfer member to generate heat. A heat transfer member is provided to transfer the heat to the plural semi conductive transfer members.

27 Claims, 11 Drawing Sheets

FIG. 11

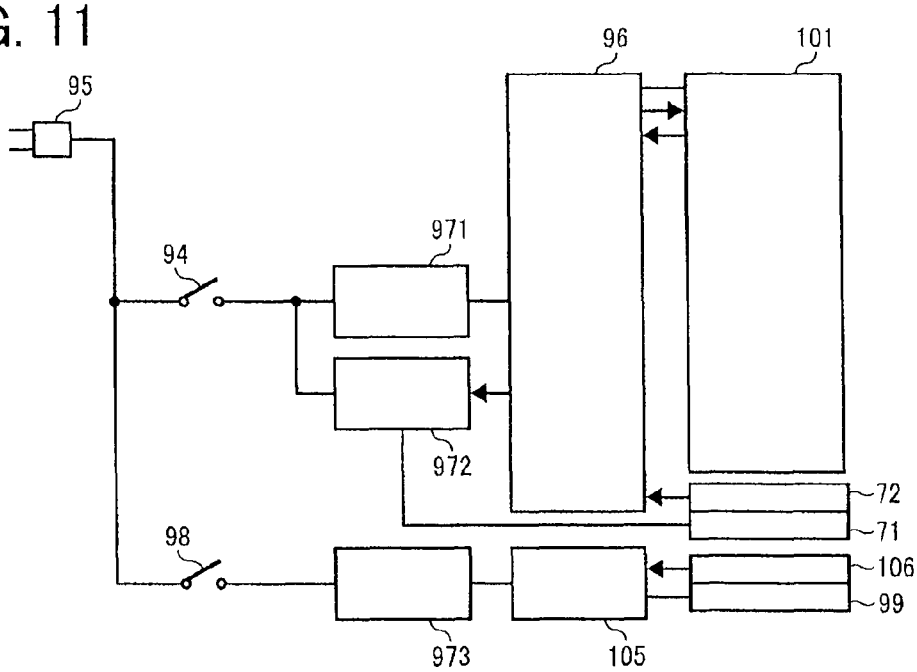

FIG. 12

TABLE 1

| NAME OF PARTS | NUMBER | PRACTICAL EXAMPLE | COMPARATIVE EXAMPLE | CONVENTIONAL EXAMPLE |
|---|---|---|---|---|
| PHOTOCONDUCTIVE MEMBER Y | 11Y | +5.9 | +6.8 | +1.1 |
| PRIMARY TRANSFER ROLLER Y | 14Y | +6.1 | +7.1 | +1.2 |
| PHOTOCONDUCTIVE MEMBER C | 11C | +11.4 | +12.3 | +2.4 |
| PRIMARY TRANSFER ROLLER C | 14C | +13.6 | +15.6 | +3.0 |
| PHOTOCONDUCTIVE MEMBER M | 11M | +14.2 | +17.9 | +4.4 |
| PRIMARY TRANSFER ROLLER M | 14M | +16.6 | +20.9 | +5.5 |
| PHOTOCONDUCTIVE MEMBER K | 11K | +7.6 | +11.1 | +5.3 |
| PRIMARY TRANSFER ROLLER K | 14K | +8.2 | +12.5 | +6.7 |
| REPULSIVE FORCE ROLLER | 51 | +9.1 | +14.8 | +5.8 |
| SECONDARY TRANSFER ROLLER | 23 | +4.6 | +13.0 | +8.8 |
| BELLCRE OPPOSING ROLLER | 221 | +11.7 | +15.0 | +3.6 |

FIG. 13A

TABLE 2

| | REPULSIVE FORCE ROLLER | | SECONDARY TRANSFER ROLLER | |
|---|---|---|---|---|
| | VOLTAGE [kV] | RESISTANCE [logΩ] | VOLTAGE [kV] | RESISTANCE [logΩ] |
| 10°C 15% | 7.7 | 8.19 | 0.44 | 6.94 |
| 15°C 11% | 5.9 | 8.07 | 0.36 | 6.86 |
| 20°C 8% | 4.2 | 7.92 | 0.30 | 6.78 |
| 23°C 50% | 3.1 | 7.79 | 0.27 | 6.73 |
| 28°C 80% | 1.7 | 7.53 | 0.19 | 6.58 |

FIG. 13B

TABLE 3

| | REPULSIVE FORCE ROLLER | | SECONDARY TRANSFER ROLLER | |
|---|---|---|---|---|
| | VOLTAGE [kV] | RESISTANCE [logΩ] | VOLTAGE [kV] | RESISTANCE [logΩ] |
| 10°C 15% | 0.44 | 6.94 | 7.7 | 8.19 |
| 15°C 11% | 0.36 | 6.86 | 5.9 | 8.07 |
| 20°C 8% | 0.30 | 6.78 | 4.2 | 7.92 |
| 23°C 50% | 0.27 | 6.73 | 3.1 | 7.79 |
| 28°C 80% | 0.19 | 6.58 | 1.7 | 7.53 |

HEAT TRANSMISSION MEMBER INCLUDED IMAGE FORMING APPARATUS

CROSS REFERENCE TO RELATED APPLICATIONS

This application claims priority under 35 USC §119 to Japanese Patent Application Nos. 2008-255871, 2008-318690, and 2009-131729, filed on Oct. 1, 2008, Dec. 15, 2008, and Jun. 1, 2009, respectively, the entire contents of which are herein incorporated by reference.

BACKGROUND OF THE INVENTION

1. Field of the Invention

The present invention relates to an image forming apparatus, such as a copier, a printer, etc., and in particular, to a tandem type image forming apparatus including either a printing medium conveyance device that conveys a printing medium onto which plural toner image are directly transferred from image bearers or an intermediate transfer member that receives and transfers plural toner images transferred from the image bearers onto a printing medium at once. More particularly, the present invention relates to an image forming apparatus including a heat generating member and a heat transfer member inside the printing medium conveyance device or the intermediate transfer member.

2. Discussion of the Background Art

Conventionally, an image forming apparatus is equipped with a heating device that heats a transfer device to adjusts transfer environment and obtain a high quality image so that a transfer problem of a toner image can be resolved. For example, the Japanese Patent Application Laid Open No. 9-96971 discloses an image forming apparatus having a heat generating member that keeps temperature of a secondary transfer roller for the purpose of decreasing an environmental change of a resistance of a semi conductive secondary transfer roller within a prescribed ranged. Further, the Japanese Patent Application Laid Open No. 9-96971 controls temperature using a heat generating member that is controlled by a control device connected to a power supply of a separate lineage from a control system for a main apparatus, so that the power supply can be distributed to the heat generating member via the separated lineage and the temperature can be maintained even if a main power supply is turned off.

The Japanese Patent Application Laid Open No. 3-288174 discloses an image forming apparatus including a plate like heat generating member having a temperature self control function. Specifically, as mentioned above, the heat generating member is employed to decrease an environmental change of a resistance of a semi conductive secondary transfer roller within a prescribed range. In the image forming apparatus of the Japanese Patent Application Laid Open No. 3-288174, a thin cubic plate like heat generating member is cylindrically rolled up, and is inserted into the transfer roller. The Japanese Patent Registration No. 3,214,889 discloses an image forming apparatus that includes a heater arranged within a cleaning backup roller that internally contacts an intermediate transfer belt opposing a cleaning blade to remove toner remaining on the intermediate transfer belt. A heater is employed to maintain temperature of all of the intermediate transfer belt and the cleaning belt so that Young's modulus and flexibility of these devices and a fine cleaning performance can be maintained.

In the above-mentioned prior arts, plural members arranged either inside or outside the intermediate transfer member cause a problem in low temperature environment, thereby necessitating temperature keeping. Thus, they are each preferably provided with a heat generating member. However, numbers of the heat generating members increase cost. Further, since heat generating members which keep temperature of different members are closely arranged to each other, a space for the heat generating members becomes narrower. Otherwise, the image forming apparatus becomes bulky when the space is newly added. For the same reason, when a member is heated by a heat generating member that mainly heats a different member, temperature thereof excessively increases and causes heat interruption.

SUMMARY OF THE INVENTION

Accordingly, an object of the present invention is to improve such background arts technologies and provides a new and novel image forming apparatus for transferring and superimposing toner images formed on plural image bearers onto an endless intermediate transfer member in an electric field created between the plural image bearers and plural semi conductive transfer members internally contacting the intermediate transfer member. Such a new and noble image forming apparatus includes a heat generating member arranged inside the endless intermediate transfer member to generate heat. A heat transfer member is provided to transfer the heat to the plural semi conductive transfer members.

In another embodiment, a cleaning backup member is arranged below the heat transfer member, and the heat generating member is arranged either approximating or contacting the cleaning backup member.

In yet another embodiment, plural heat shielding plates are provided to close an inner space of the intermediate transfer member.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 11 is a chart typically illustrating yet another manner of controlling temperature in an image forming apparatus;

FIG. 12 illustrates an exemplary difference of temperature between parts and ambient atmosphere; and FIGS. 13A and 13B illustrate exemplary comparison of voltage and resistance.

DESCRIPTION OF THE PREFERRED EMBODIMENTS

Figure 1:
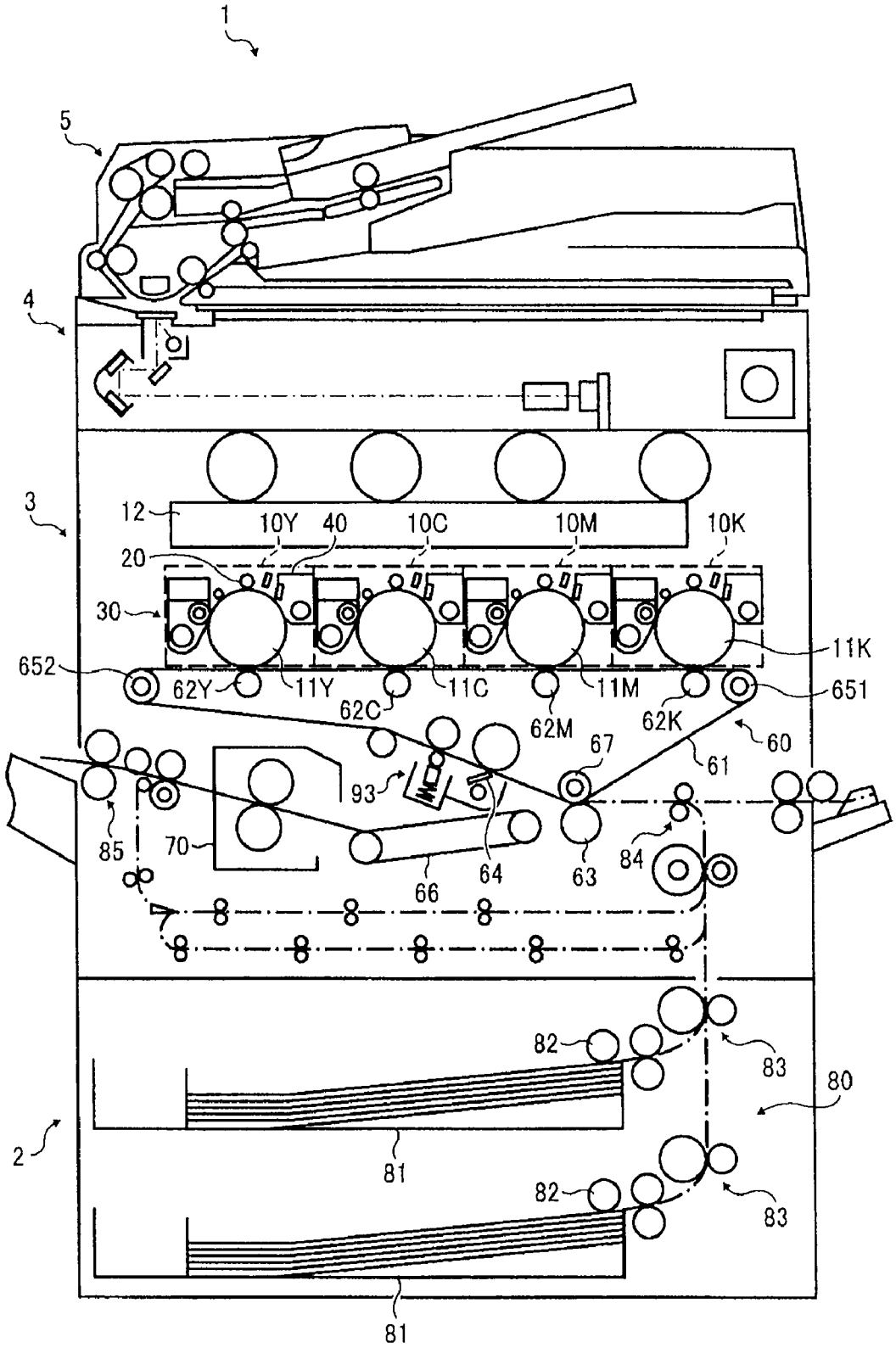
FIG. 1 is a chart schematically illustrating the entire image forming apparatus including four image formation units arranged in parallel and an intermediate transfer belt, onto which a toner image is transferred, according to one embodiment of the present invention.

Referring now to the drawing, wherein like reference numerals designate identical or corresponding parts throughout several views in particular in FIG. 1, an image forming apparatus includes, from the upper side, an automatic document feeder 5 that automatically conveys original documents placed thereon, a scanner 4 that reads the original document, an image formation section that forms toner images, and a sheet feeding section 2 that accommodates and supplies printing mediums, such as printing sheets etc. The image forming apparatus 1 includes an image formation section 3 at a core section thereof. The image formation section 3 includes four image formation units 10 formed as process cartridges arranged horizontally side by side in parallel in a tandem state corresponding to respective colors of Yellow (Y), Magenta (M), Cyan (C), Black (K). Above the four image formation units 10Y to 10K, an exposure device 12 is provided to expose the surfaces of the photoconductive members 11 with charge in accordance with image data of respective colors. Further, below the four image formation units 10Y to 10K, a transfer device 60 having an intermediate transfer belt made of heat resistant material of middle resistance, such as polyimide, polyamide, etc., wound and supported and thereby rotated by plural rollers 651 and 652, is provided. Since each of the image formation units 10 has almost similar configurations, symbols Y to K to be assigned to devices are omitted when they are unrelated to the colors. The image formation units 10Y to 10K include the photoconductive members 11Y to 11K, respectively. Around the photoconductive members 11, there are provided chargers 20 that apply electric charge to the surface of the photoconductive members 11, developing devices 30 that develop latent images formed on the surfaces with toner of respective colors, lubricant coating devices that coat the surfaces with lubricant, not shown, and cleaning devices having cleaning blades for cleaning the surface at positions downstream of toner transfer sections are arranged, respectively. Thus, one image formation unit 10 is formed. The image formation unit 10 integrally includes the photoconductive member 11 with more than one of the charger 20, the developing device 40, the cleaning device 20, and the lubricant coating device, and is detachable to the image forming apparatus 1.

The photoconductive member 11 is made of metal, such as amorphous silicone, selenium, etc., or an inorganic material as typically mentioned below. The inorganic photoconductive member 11 includes a conductive supporting member, a resin layer overlying the supporting member with dispersant of filler, a photoconductive layer overlying the resin layer having an electric charge layer and an electric charge transportation layer, and a protection layer with dispersant of filler. The photoconductive layer generally includes a single layer having electric charge generation substance and electric charge transportation substance. It preferably includes a laminate layer constituted by electric charge generation and transportation layers and is excellent because of high sensitivity and durability. The electric charge generation layer is produced by dispersing colorant having an electric charge generation capability into solvent together with binder resin upon need using a ball-mill, an attritor, a sand mill, and a ultrasonic wave or the like. Then, the mixture is coated and dried on the conductive supporting member, whereby the electric charge generation layer is obtained. As combination resin, polyamide, polyurethane, epoxy resin, polyketone, polycarbonate, silicone resin, acrylic resin, polyvinyl butyral, polyvinyl methylal, polyvinyl ketone, polystyrene, polysulfone, poly-N-vinyl carbazole, polyacrylamide, polyvinyl benzal, polyester, phenoxy resin, polyvinyl-chloride vinyl acetate copolymer, polyvinyl acetate, polyphenylene oxide, polyamide, polyvinyl pyridine, cellulose resin, casein, polyvinyl alcohol, and polyvinyl pyrrolidone or the like are exemplified. The amount of combining resin is from zero to 500 weight part in relation to 100 weight part of the electric charge generation substance, and is preferably, from 10 to 300 weight part. The electric charge transportation layer can be produced by first solving or dispersing combination resin in appropriate solvent with electric charge transportation substance. Then, the dispersion or solvent is coated onto the electric charge generation layer. As the electric charge transportation layer, an electron hole transportation substance and the electronic transportation substance is exemplified. As the combining resin, thermal plasticity resin or thermosetting property resin, such as polystyrene, styrene-acrylicnitrile copolymer, styrene-butadiene copolymer, styrene-maleic anhydride copolymer, polyester, polyvinyl chloride, polyvinyl chloride-chloride vinyl acetate copolymer, polyvinyl acetate vinyl, polyvinylidene chloride, PAR, phenoxy resin, polycarbonate, accetylcellulose resin, ethyl cellulose resin, polyvinyl butyral, polyvinyl toluene, poly-N-vinyl carbazole, acrylic resin, silico-polyvinyl formal resin, epoxy resin, melamine resin, urethan resin, phenol resin, alkyd resin, etc., are exemplified. Further, the protection layer can sometimes be arranged on the photoconductive layer. By providing the protection layer and thereby improving the durability, the photoconductive member 11 can be used avoiding abnormality while keeping high sensitivity. As material of the protective layer, resin, such as ABS, ACS, olefin-vinylmonomer-copolymer, chlorinated polyether, allyl, phenol, polyacetal resin, polyamide, polyamide-imide, polyacrylate, polyallylsulfonate, polybutylene, polybutyleneterephthalate, polycarbonate, PAR, polyethersulfone, polyethylene, polyethylene terephthalate, polyimide, acrylic, polymethylpentene, polypropylene, polyvinylidene chloride, epoxy, etc., is exemplified. Among them, either the polycarbonate or the PAR can be most preferably utilized. Beside, for the purpose of improving abrasion resistance, fluorine resin, such as polytetrafluoroethylene, etc., silicone resin, and mixture of the fluorine resin or the silicone resin, into which organic filler or inorganic filler such as oxidized titan, oxidized tin, potassium titanate, and silica, etc., is dispersed, can be added to the protection layer. Filler density in the protection layer varies in accordance with its type and a processing condition for electro photographing with a photoconductive member 11. As a ratio of the filler to the entire solid amount on the outermost side of the protection layer, not less than five weight part, preferably, not less than from ten to not more than fifty weight part, and more preferably, not more than thirty weight part is used.

The charge device 20 includes a charge roller 21 as a charger having a conductive core metal wrapped with an elastic layer having a middle range resistance. The charge roller 21 is connected to a power supply to receive prescribed DC and/or AC voltages. The charge roller 21 is made of elastic resin and discharges ion of current. To adjust electric resistance, the charge roller sometimes includes inorganic conductive material, such as carbon black, etc., and ion conductive material. Further, the charge roller 21 is arranged beside the photoconductive member 11 via a prescribed small gap. The gap can be provided by winding a spacer member having a prescribed thickness around both ends of the charge roller 21 while arranging the spacer member in contact with the surface of the photoconductive member 11. The charge roller 21 can be contacted not to separate from the photoconductive member 11. The charge roller 21 generates charges in the vicinity of the photoconductive member 11 and discharges thereof. By arranging in the vicinity via a gap, the charge roller 21 can be prevented or suppressed from being contaminated by toner remaining after a transfer process. A charge cleaner roller, not shown, is provided for the charge roller 21 to contact and clean the surface of the charge roller 21. In the developing device 40, there is provided a developing sleeve having a magnetic field generation device, not shown, opposing the photoconductive member 11. A stirring and conveying screw is arranged below the developing sleeve, and includes a mechanism for mixing and stirring toner supplied from a table, not shown, while lifting the mixture to the developing sleeve. Developer including the toner and magnetic carrier conveyed by the developing sleeve 1 are flattened to have a prescribed thickness by an adjusting member. The developing sleeve rotates in the same direction as the photoconductive member 11 while carrying the developing and supplies the developer to the photoconductive member 11 at a position opposing the photoconductive member 11. Further, toner cartridges of respective colors storing not used toner are detachably installed in spaces existing above the photoconductive members 11. The toner is supplied upon need to the respective developing devices by a toner conveyance device, such as a mohno pump, an air pump, etc. The black use toner cartridge can have especially large capacity due to a lot of consumption. The cleaning device 40 includes an engageable mechanism freely engaging and disengaging the cleaning blade with the photoconductive member 11 under a control of a control section provided in the image forming apparatus. The cleaning blade contacts in counter to the rotation of the photoconductive member 11, so that toner and additives, such as talc, kaolin, calcium carbonate, etc., remaining on the photoconductive member 11 as stein of the printing medium can be removed therefrom. The toner or the like thus removed is conveyed and stored in a used toner container by a used toner collecting coil 22.

The transfer device 60 includes an intermediate transfer belt 61 onto which toner images are superimposed, primary transfer rollers 62 that transfer and superimpose toner images carried on the photoconductive member 11 onto the intermediate transfer belt 61, and a secondary transfer roller 63 that transfers the superimposed toner image onto a printing medium and the like.

The transfer device 60 includes a facing member 67 inside the intermediate transfer belt 61 at a position opposing the secondary transfer roller 63. Plural primary transfer rollers 62 are arranged at positions opposing the respective photoconductive members 11 via the intermediate transfer belt 61 to transfer toner images formed on the photoconductive members 11 to the intermediate transfer belt 61 as primary transfer. The primary transfer rollers 62 are connected to a power supply, not shown, and receive prescribed DC and/or AC voltages. The polarity is opposite to that of electric charge of the toner to move the toner from the photoconductive member 11 toward the intermediate transfer belt 61 in the primary transfer. Further, the primary transfer rollers are preferably semi conductive by including inorganic conductive material, such as carbon black, etc., and ion conduction material for the purpose of adjusting electric resistance. Since transfer efficiency does not change even when the resistance of the primary transfer roller 62 is different, but largely changes when an image area ratio is different, the transfer efficiency is hardly maintained to be stable. That is because, when the image area ration is small while current flows to a section of a transfer nip on a priority base, in which toner does not exist, a transfer voltage decreases and an electric field necessary for the transfer process is hardly obtained.

Especially, influence of resistance of the toner existing in the transfer section becomes large when the resistance of the primary transfer roller 62 is low. Thus, the lower the resistance of the primary transfer roller 62, more prominent the influence. Thus, when constant current control is executed, a high resistance primary transfer roller 62 is preferably employed. However, when the resistance exceeds $5\times10^8$ ohm, a toner image is possibly increasingly disturbed by leakage of current. Accordingly, the resistance preferably ranges from not less than $1\times10^5$ ohm to not more than $5\times10^8$ ohm. The above-mentioned phenomenon, i.e., current flows through the section where no toner exists on a priority base, is caused not only by the toner resistance, but also flowing of transfer current toward a larger voltage difference section. Because, a difference of voltage between the core metal of the primary transfer roller 62 and the photoconductive member 11 is larger at a section where development is not executed by the toner than that executed. Such a phenomenon occurs in an image forming apparatus at a section where the photoconductive member 11 receives image exposure and loses the charge of the photoconductive member to form a toner image having the same polarity as the photoconductive member 11. The photoconductive member voltage is higher at the section where the toner image is not formed, while lower where the same is formed, respectively. However, since the polarity of the transfer voltage is opposite to that of the photoconductive member voltage, a difference of voltage between the primary transfer and the photoconductive member is larger where the development of the toner is not executed than executed. When the resistance of the primary transfer roller 62 increases in the low temperature environment, the range of from not less than $1\times10^7$ ohm to not more than $5\times10^8$ ohm is hardly entered, and accordingly, a voltage applied to a repelling force roller 67 increases and thereby leakage occurs. Because, secondary transfer is controlled by constant current. Then, like the image formation layer 1 of one embodiment of the present invention, when an apparatus is disposed in the low temperature environment, the leakage can be prevented by keeping heat in all of the primary transfer layers 62 and whereby suppressing the increase of the resistance of the all of primary transfer rollers 62.

Further, a toner image superimposed on the intermediate transfer belt 61 is transferred onto a printing medium by a secondary transfer roller 63 as secondary transfer. Similar to the primary transfer roller 62, a power supply, not shown, is connected to the secondary transfer roller 63 to supplies DC and/or AC voltages thereto. The polarity of the voltage to be applied is opposite to that of electric charge of toner, and executes the secondary transfer by extracting the toner from the intermediate transfer belt 61 to the printing medium when it is conveyed. Further, inside the intermediate transfer belt 61, a facing member 67 is arranged opposing the secondary transfer roller 63. By biasing and approximating the facing member 67 in the vicinity of the secondary transfer roller 63, transfer efficiency of the toner increase, and a high quality image can be obtained. Further, by applying a voltage of the same polarity as the toner to the facing member 67, a repelling force against the toner is generated therein. Thus, the facing member can serve as a repelling force member 67. A power supply, not shown, is connected to the repelling force roller 97 to apply prescribed DC and/or AC voltages thereto so that electric charge of the toner has the same polarity. Thus, the toner images superimposed on the intermediate transfer belt 61 can be transferred onto the printing medium 9 due to repelling force applied from inside the intermediate transfer belt 61.

In addition, by simultaneously using the secondary transfer roller 63, the transfer efficiency is further improved. The repelling force roller 67 and the secondary transfer roller 63 are connected to a power supply, not shown, to receive a voltage having a prescribed polarity. A contact section, in which the repelling roller 67, the secondary transfer roller 63, and the intermediate transfer belt 61 serves as a secondary transfer section to transfer the toner image onto the printing medium.

Further, there is provided an intermediate transfer belt cleaning device 64 that cleans the surface of the intermediate transfer belt 61 after the secondary transfer process. Specifically, a cleaning blade 642 and a mechanism that freely engages and disengages the cleaning blade 642 with the intermediate transfer belt 61 under control of a control section of the image forming apparatus body 1 are provided. The cleaning blade contacts the intermediate transfer belt 61 in a counter direction. Thus, toner and additives of a printing medium remaining and sticking as stein on the intermediate transfer belt 61*b* are removed and cleared. Such toner or the like is then collected and stored in the container, not shown. Further, inside the intermediate transfer belt 61 of the transfer device 60, there are provided a heat generating member 69 and a heat transfer member that transmits heat generated by the heat generating member to the respective primary transfer rollers 62Y to 62K and the like as mentioned later in detail.

Further, a lubricant coating device 93 that coats the intermediate transfer belt 621 with lubricant is provided in the image forming apparatus 1. The lubricant coating device 93 includes solid lubricant agent 932 contained in a casing and a lubricant agent coat blade 934 that contacts and shaves the solid lubricant agent 932 and coats the intermediate transfer belt 61 therewith. The solid lubricant agent 932 is shaped as a cubic and is biased to a brush roller 931 by a pressurizing spring 933. Thickness of the solid lubricant agent 932 decreases as the solid lubricant agent 932 is shaved and time elapses. However, the solid lubricant agent 932 always contacts the brush roller 931 due to pressure of the pressurizing spring 933.

The brush roller 931 rotates and coats the intermediate transfer belt 61 with the lubricant while shaving thereof. Further, a lubricant coating device having the same function can be arranged for the photoconductive member 11. In this embodiment, a lubricant agent coat blade 934 is arranged to contact the intermediate transfer belt 61 at downstream of a position where the branch roller 931 coats it with the lubricant agent. The lubricant agent coat blade 934 includes rubber to serves as a cleaning device while contacting the intermediate transfer belt 61 in a counter direction. The solid lubricant agent 932 can include a dried solid hydrophobic nature lubricant agent, such as zinc stearate, metal chemical compound having fatty acid group (e.g. stearic acid, oleic acid, palmitic acid), etc.

Further, wax, such as candelilla wax, carnauba wax, rice wax, woody wax, hihiba-abura, beeswax, lanoline, etc., can be used.

Bellow the transfer device 60, there is provided a fixing device 70 that almost eternally fixes the toner image onto the printing medium. Even not shown, the fixing device 70 includes a fixing roller having a halogen heater and a pressurizing roller pressure contacting the fixing roller. Instead of the fixing roller 71, a heating roller having a halogen heater and an endless fixing belt wound around a heating roller and a fixing roller, not shown, can be used. Further, instead of the heater, an electromagnetic induction heating device that provides heat to the roller can be employed. The fixing device 70 is controlled by a control device, not shown, to provide an optimum fixing condition in accordance with a type of a sheet, a full color or a mono color, and a simplex or a duplex. At the bottom most section of the image forming apparatus 1, there is provided a sheet feeding device 80 that accommodates and launches printing mediums toward the transfer device 60.

Figure 2:
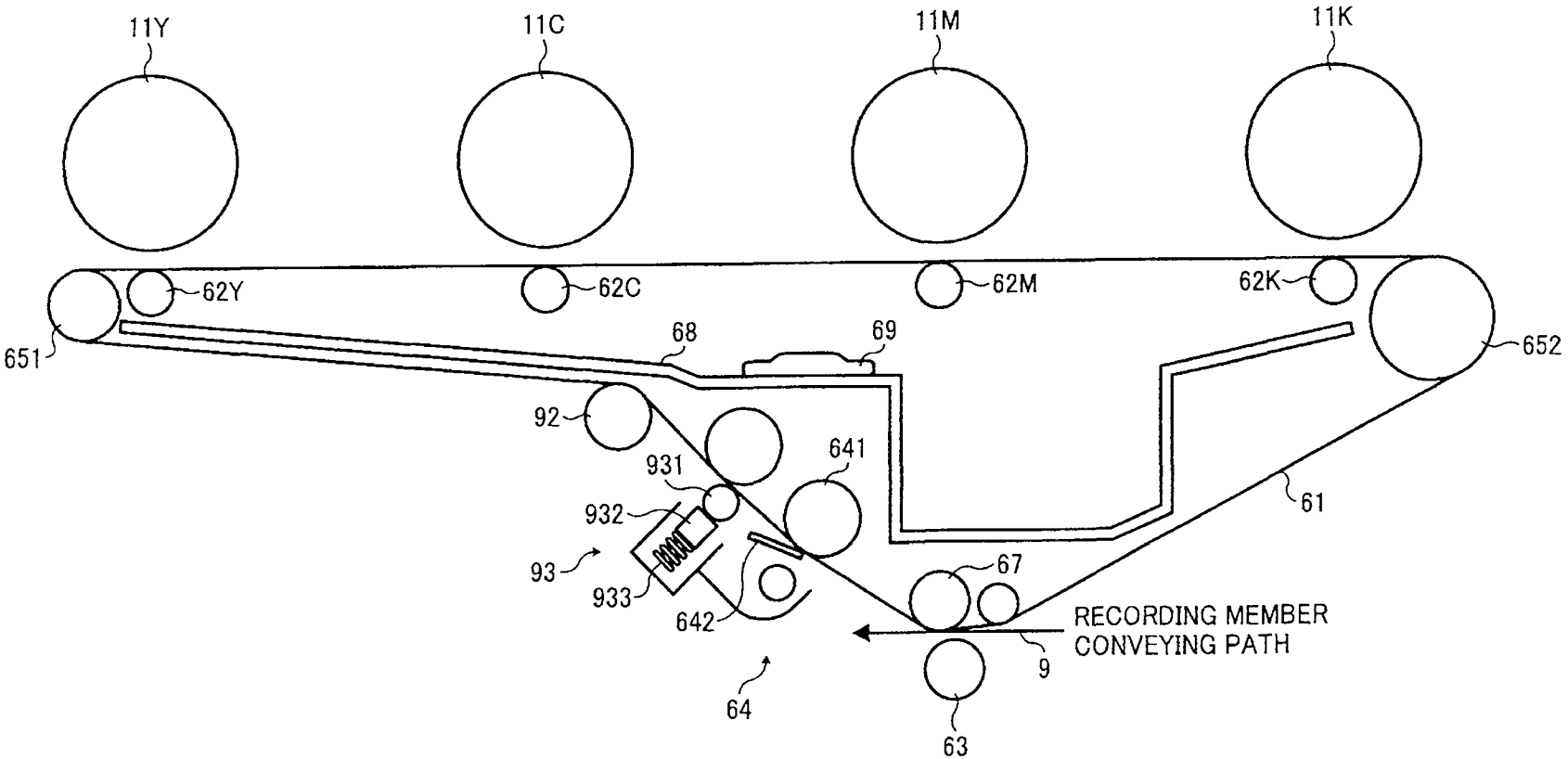
FIG. 2 is a chart schematically illustrating surroundings of the intermediate transfer belt included in the image forming apparatus according to one embodiment of the present invention.

In the image forming apparatus according to one embodiment of the present invention, there are provided a heat generating member 69 and a heat transfer member 68 that transmits heat generated by the heat generating member 69 to respective primary transfer rollers 62Y to 62K as shown in FIG. 2. As shown, developed toner images on plural photoconductive members 11 are transferred and superimposed on an endless intermediate transfer belt 61 in a primary transfer process. Then, the superimposed transferred toner images are transferred onto a printing medium in a secondary transfer process. Thus, the image forming apparatus 1 includes semiconductive primary transfer rollers 62 internally contacting the intermediate transfer belt 61. Primary transfer from the respective photoconductive members 11 to the intermediate transfer belt 61 is executed in electric fields 61 created between semiconductive primary transfer rollers 62 and the photoconductive members 11. The image forming apparatus 1 also includes a semiconductive repelling force roller 67 internally contacting the intermediate transfer belt 61 at opposite sides of the respective primary transfer rollers 62 and a secondary transfer roller 63. An electric field is created between the semiconductive repelling force roller 67 and the secondary transfer roller 63 to execute secondary transfer from the intermediate transfer belt 61 to the printing medium. A plate like heat generating member 69 is arranged inside the intermediate transfer belt 61. A heat transfer member 68 is provided to transmit heat generated by the plate like heat generating member 69 to the primary transfer rollers 62 serving as primary transfer members. The plate like heat generating member 69 is flat and widely generates heat. Thus, by internally providing the heat either to the image forming apparatus 41 or the intermediate transfer belt 61, temperature of an ambient of the inner space can be adjusted constant. Thus, by suppressing a change caused by environment, prescribed transfer efficiency and prescribed toner transfer weight can be obtained. As a result, a high quality image can be constantly obtained for a long time.

Further, as shown, the heat transfer plate 68 extends below over the primary transfer rollers 62. Specifically, such a heat transfer plate 68 has a size capable of internally extending all over the intermediate transfer belt 61 to be able to abut all of the primary transfer rollers 62Y to 62K, the repelling force roller 67, and a cleaning backup roller 641.

Since the heat transfer plate 68 employs high heat conductivity material, temperature of the inner side of the intermediate transfer belt 61, the primary transfer rollers 62Y to 62K arranged at the upper side, and the photoconductive members 11Y to 11K arranged above the primary transfer rollers 62Y to 62K can be almost equalized. The heat transfer plate 68 is preferably one body in view of heat conductivity.

However, plural parts architecture assembled by using screws or adhesives of high conductivity such as silicone, etc., can be employed. The plate like heat generation member 69 is arranged almost at the center of the heat transfer plate 68.

Figure 9:
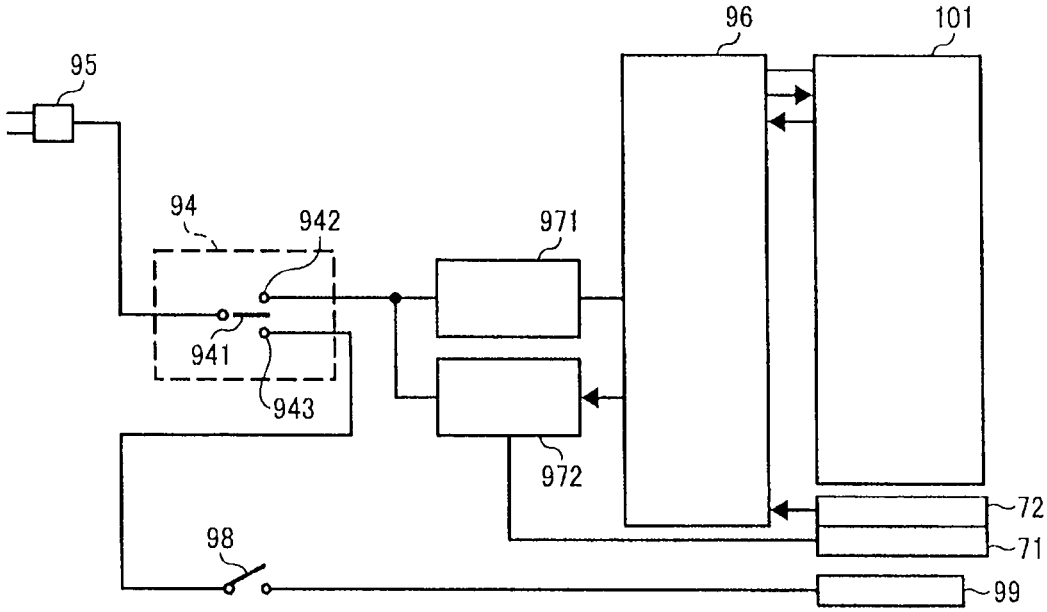
FIG. 9 is a chart typically illustrating a manner of controlling temperature in an image forming apparatus.
Figure 10:
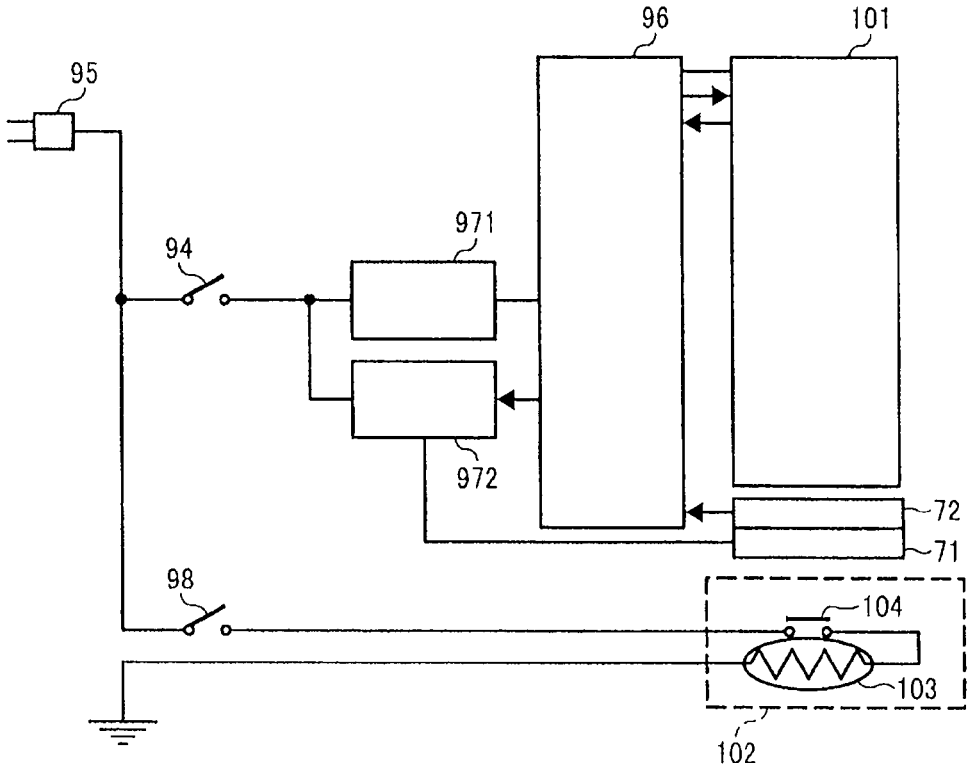
FIG. 10 is a chart typically illustrating another manner of controlling temperature in an image forming apparatus.

As described later with reference to FIGS. 9 to 11, heat generation of the plate like heat generating member 69 can be achieved using a private use power supply or a commercial use power supply taken in via an outlet. The plate like heat generating member 69 contacts the heat transfer plate 68 via high heat conductive screw or adhesion, such as silicone, etc. Further, by either approximating or contacting the heat transfer plate 68 to the primary transfer rollers 62, temperature of the primary transfer rollers 62, and ambient temperature and humidity of its surroundings can be readily adjusted. Further, heat generated by fewer heat generation members 63 can be transmitted to the primary transfer rollers 62 that need temperature keeping via the heat transfer plate 68.

Further, heat tends to increase. Thus, by arranging the heat transfer plate 68 below the primary transfer rollers 62, efficiency of temperature keeping can be improved. In this way, the heat generated by the plate like heat generating member 69 travels to the heat transfer plate 68. Since heat conductivity of the heat transfer plate 68 is high, temperature becomes almost constant all over the heat transfer plate 68. By approximating to the heat transfer plate 68, the primary transfer rollers 62Y to 62K, the repelling force roller 67, the cleaning blade 642, and the intermediate transfer belt 61 all necessitating temperature keeping can be given heat via either ambient air or far-infrared radiation.

Figure 3:
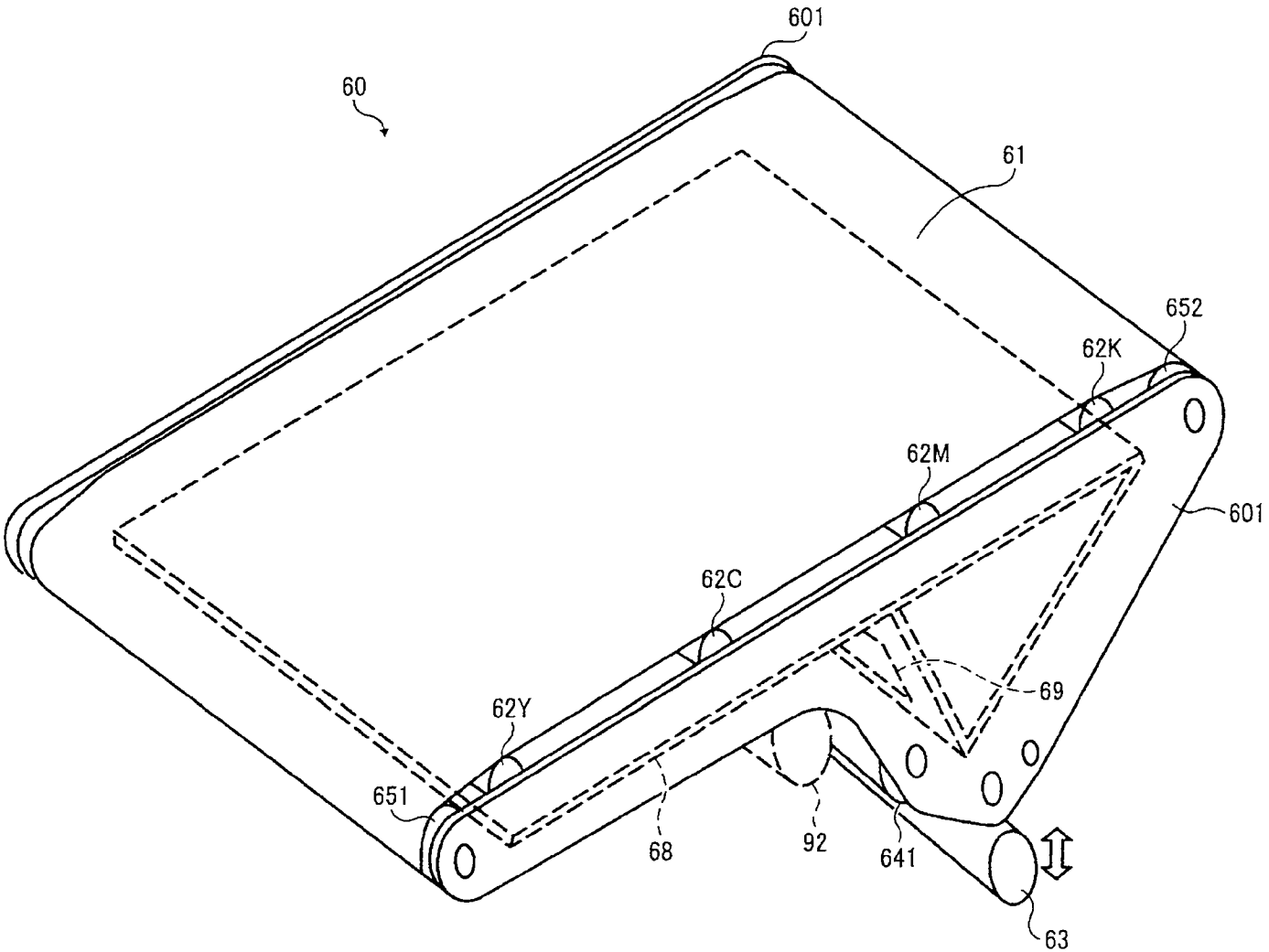
FIG. 3 is a perspective view illustrating an exemplary transfer device having a pair of heat shielding side plates according to one embodiment of the present invention.

A modification of the image forming apparatus 1 is now described with reference to FIG. 3. As shown, a pair of heat shield side plates 601 is provided to form a closed space in the intermediate transfer belt 61. As shown, a heat transfer member 68 is almost flat and closely arranged extending over a flat portion of the intermediate transfer member 61. The heat transfer member partially includes a sharp angle protruding toward the repelling force roller 67. Further, the heat generating member 69 is arranged in the vicinity of a belt cleaning device 64 and a lubricant agent coat device 93. The heat shielding plates 601 are arranged at both side ends of the intermediate transfer belt 61 and forms a closed space in the intermediate transfer belt 61. Thus, heat generated by the heat generating member 69 stays long in the closed space as ambient heat, so that ambient temperature can be maintained constant therein. Further, by extending the heat transfer plate 68 in the closed space and approximating it to the primary transfer roller 62, environmental climate, such as ambient temperature, humidity, etc., of the primary transfer roller 62 can be readily adjusted, because air rarely flows. In such a situation, the heat shielding plates 601 can be arranged at both ends of one of the rollers 651 and 652 supporting the intermediate transfer belt 61. Further, a heat transmission plate 68 can be used as a structure member supporting the heat shielding plate 601.

Figure 4:
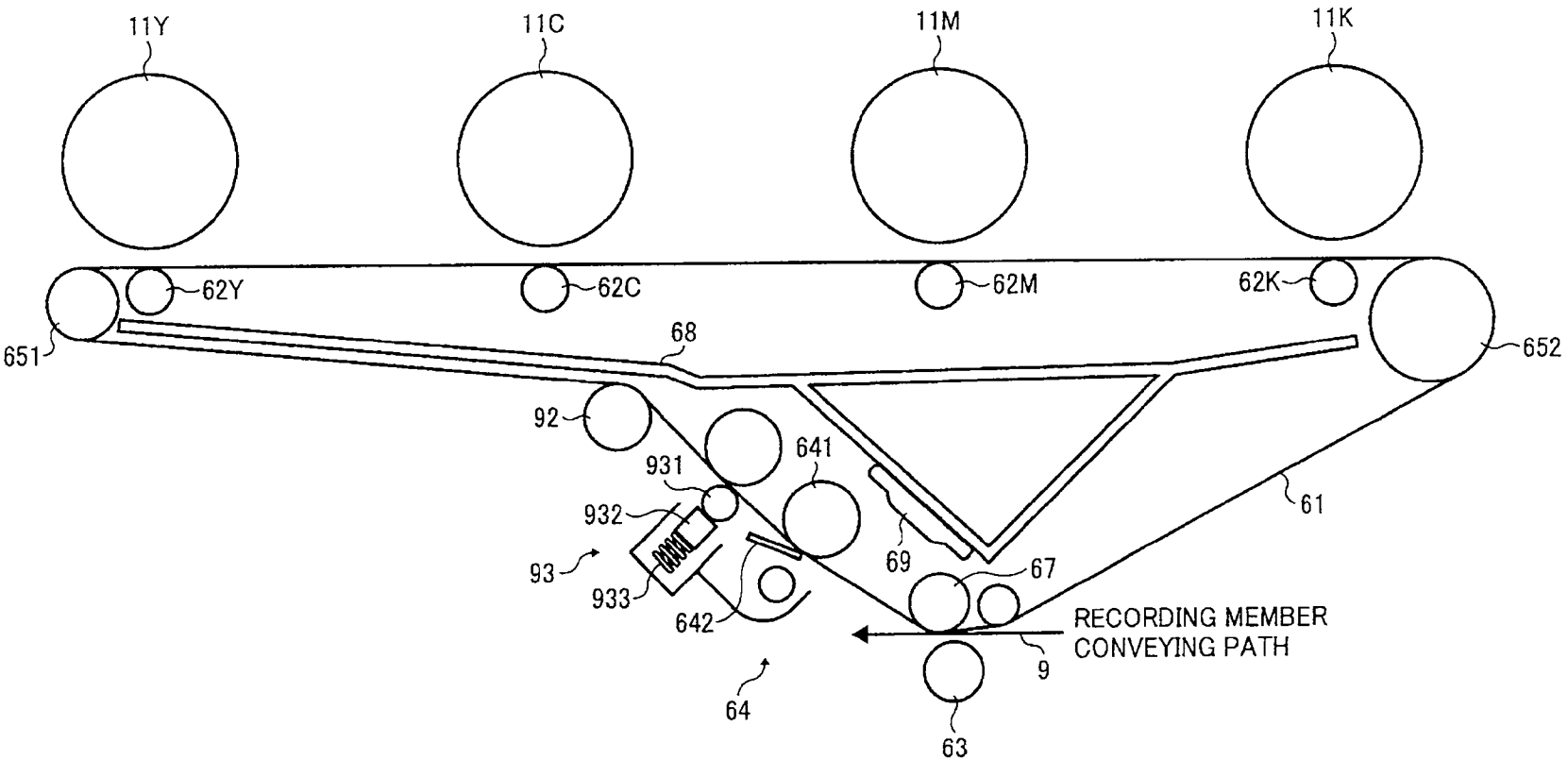
FIG. 4 is a chart schematically illustrating surroundings of the intermediate transfer belt included in the image forming apparatus according to another embodiment of the present invention.

The heat transfer plate 68 transmits heats of the plate like heat generating member 69 to the repelling force roller 67. Further, electric resistance of the secondary transfer roller 63 is smaller than that of the repelling force roller 67. Now, another embodiment is described with reference to FIG. 4. The repelling force roller 67 receives a voltage of the same polarity as toner and generates a repelling force against the toner. Thus, by simultaneously using a secondary transfer roller 63 that receives a voltage of an opposite polarity to that of the toner and generates an attracting force attracting the toner, transfer efficiency can be improved. The repelling force roller 67 and the secondary transfer roller 63 are connected to a power supply, not shown, and receive a voltage of a prescribed polarity. Thus, by applying a prescribed voltage to at least one of the repelling force roller 67 and the secondary transfer roller 63, the toner can be transferred onto a printing medium 9 from the intermediate transfer belt 61. At this moment, electric resistance of the secondary transfer roller 63 is smaller than that of the repelling force roller 67. Further, the heat transfer plate 68 is arranged either to approximate or to contact the repelling force roller 67. Thus, temperature control of the repelling force roller 67 can be easier. Since heat is hardly transferred below the heat transfer plate 68 by means of convection, the heat transfer member 68 approximates or contacts the repelling force roller 67 arranged below the heat generating member 68. As a result, higher heat can readily travel to the repelling force roller 67 from the heat generating member 69.

The image forming apparatus further includes a cleaning blade 642 that removes toner on the intermediate transfer belt 61, and a cleaning backup roller 641 contacting the inner surface of the intermediate transfer belt 61 opposing the cleaning blade 642.

The heat transfer plate 68 further transfers the heat generated by the plate like heat generating member 69 to the cleaning backup roller 641 by either approximating or contacting the same. The cleaning belt backup roller 641 transfers the heat to the cleaning blade 642 via the intermediate transfer belt 61. Thus, both of the cleaning blade 642 for removing the toner on the intermediate transfer belt 61 and the intermediate transfer belt 61 can be kept warm while maintaining young modulus and flexibility, and accordingly, a fine cleaning performance.

Figure 5:
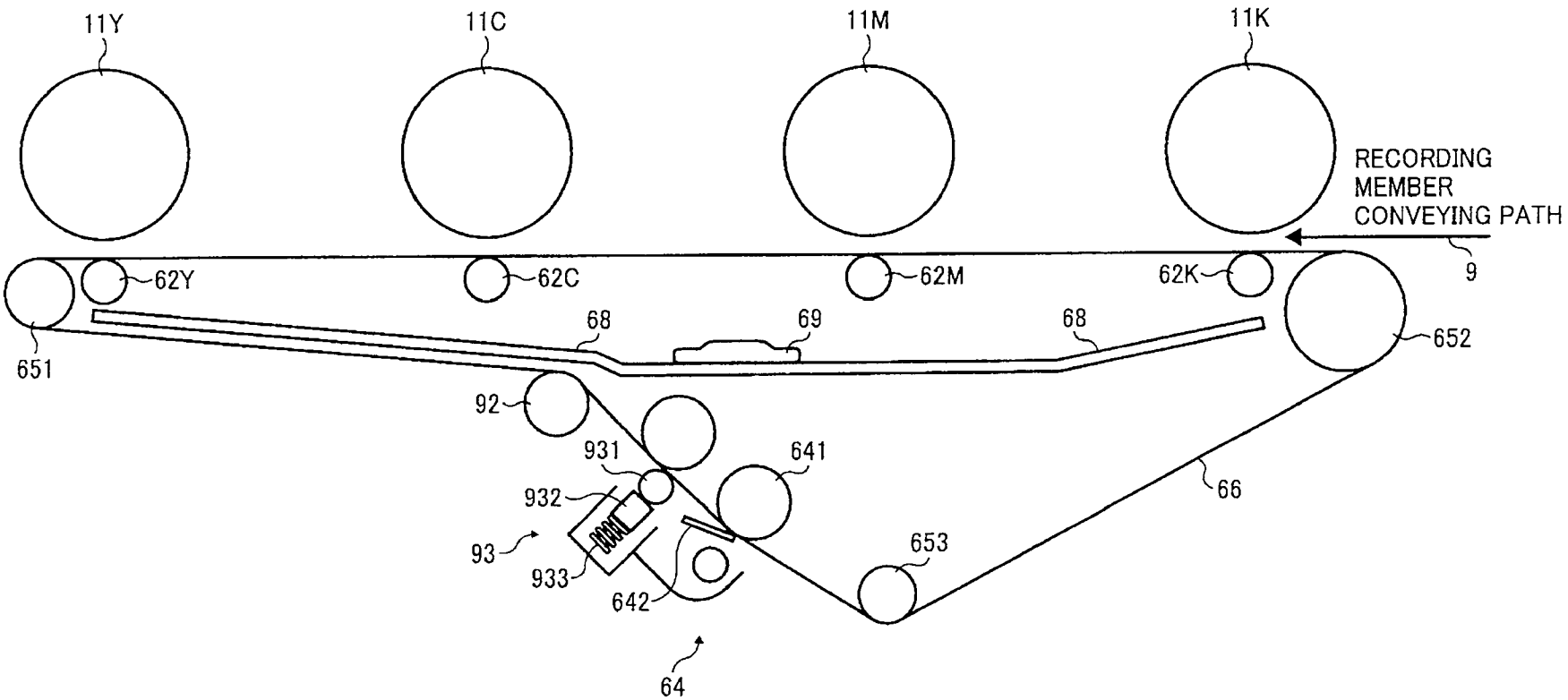
FIG. 5 is a chart schematically illustrating surroundings of a conveying belt included in the image forming apparatus for conveying a printing medium according to another embodiment of the present invention.

In the image forming apparatus 1, images are developed on the plural photoconductive members 11 and are transferred and superimposed on a printing medium that is conveyed by an endless printing medium conveying belt 66. Specifically, electric fields are created between semiconductive transfer rollers 16 and photoconductive members 11 execute transfer processes, respectively. A plate like heat generating member 69 and a heat transfer plate 68 that transfers heat generated by the plate like heat generating member 69 to transfer rollers 16 are included. Another embodiment of an image forming apparatus 1 having a printing medium conveying belt for conveying a printing medium 9, such as a printing sheet, etc., is described with reference to FIG. 5. As shown, this embodiment also includes a heat transfer plate 68 and a plate like heat generating member 69. However, the printing medium 9 is conveyed through between the photoconductive members 11 and the transfer rollers 62 opposing the photoconductive members 11. Still another embodiment of an image forming apparatus 1 having an intermediate transfer belt is described with reference to FIG. 6.

As shown, this embodiment also includes a heat transfer plate 68 and a plate like heat generating member 69. However, since a supporting roller 653 does not need temperature keeping, a heat transfer plate 68 may be separated as shown. A heat transfer plate 68*a* is provided to either engage or disengage the primary transfer roller 62K with the photoconductive member 11K. The heat transfer plate 68*a* is supported by a spring at both ends thereof, not shown, and pressurizes the primary transfer roller 62K against the photoconductive member 11K. Thus, the primary transfer roller 62K either engages or disengages with the photoconductive member 11K as the heat transfer plate 68*a* moves or rotates. A heat generating member 69*a* is attached to the heat transfer member 68*a*. A heat transfer plate 68*b* is also provided to either engage or disengage the primary transfer rollers 62Y or 62M with the photoconductive members 11Y to 11M, respectively. The heat transfer plate 68*a* is supported by a spring at both ends thereof, not shown, and pressurizes the primary transfer rollers 62Y to 62M against the photoconductive members 11Y to 11M, respectively. Thus, the primary transfer rollers 62Y to 62M either engage or disengage with the photoconductive members 11Y to 11M as the heat transfer plate 68*b* moves or rotates. A heat generating member 69*b* is similarly attached to the heat transfer member 68*b* as above. When a color image is formed, the heat transfer plate 68*a* is located at a position causing the primary transfer roller 62K to contact the photoconductive member 11K.

At that time, the heat transfer plate 68*b* is also located at a position causing the primary transfer rollers 62Y to 62M to contact the photoconductive members 11Y to 11M, respectively. Specifically, all of the primary transfer rollers contact the photoconductive members via the intermediate transfer belt 61. Whereas, when a monochrome image is formed, the heat transfer plate 68*a* is located at the position causing the primary transfer roller 62K to contact the photoconductive member 11K.

However, the heat transfer plate 68*b* is located at another position causing the primary transfer rollers 62Y to 62M to be separated from the photoconductive members 11Y to 11M, respectively. Specifically, only the primary transfer roller 62K contacts the photoconductive member 11K via the intermediate transfer belt 61, so that only a K image can be formed. Further, when an image is not formed, the heat transfer plate 68*a* is located at another position causing the primary transfer roller 62K to be separated from the photoconductive member 11K. The heat transfer plate 68*b* is also located at the other position causing the primary transfer rollers 62Y to 62M to be separated from the photoconductive members 11Y to 11M, respectively. Specifically, all of the primary transfer rollers 62Y to 62K are separated from the photoconductive members 11Y to 11K, respectively. Thus, impression can be avoided on the primary transfer rollers 62Y to 62K.

The heat transfer plate 68 is preferably made of metal including at least one of copper, aluminum, and iron. Since the metal is highly heat conductive even if the thickness thereof is from about 0.6 to about 3 mm typically used by a structure member, temperature of the heat transfer plate 68 is sufficiently uniform. The heat transfer plate 68 can be made thicker and increases temperature keeping performance while maintaining uniformity of the temperature. However, the thicker the heat transfer plate 68, the more lately temperature rises after a heater turns on. As a result, material and processing become costly, and the apparatus becomes heavier. The plate like heat generating member 69 is prepared by covering a snaking nichrome wire with a heat resistant insulation tube and wrapping it with an aluminum foil. Otherwise, the plate like heat generating member 69 is prepared by sandwiching a middle resistant member, such as rubber, plastic, etc., to which carbon fine powder is dispersed, with electrodes, such as metal, etc. Still otherwise, the plate like heat generating member 69 is prepared by weaving a middle resistant string including textile having resin in which carbon textile, metal fine powder, or carbon fine powder is mixed as a cloth, and then stitching a middle resistant string at both ends of the cloth to form electrodes. The primary transfer rollers 32*y* to 62K are preferably made of at least one of epichlorohydrin-acrylic nitrile-butadiene rubber (NBR), epichlorohydrin (ECO), and polyurethane (PUR). The repelling force roller 67 is preferably made of at least one of acrylic nitrile-butadiene rubber (NBR), Epichlorohydrin (ECO), and polyurethane (PUR). The cleaning roller 642 is preferably made of the PUR. Since the heat transfer plate 68 is made of aluminum having a thickness of about 1.6 mm, and a pair of face plates that supports bearings arranged at both ends of respective driving, driven, and repelling force rollers 651, 652, and 67 that cooperatively support the intermediate transfer belt 61 is not twisted keeping a parallel condition, parts are not additionally needed and cost can be saved.

The cleaning belt backup roller 641 transfers heat to the cleaning blade 642 opposing to the cleaning belt backup roller 641 via the intermediate transfer belt 61. Further, the primary transfer rollers 62Y to 62K transfer heat to the respective photoconductive members 11Y to 11K opposing thereto via the intermediate transfer belt 61. Since the inner space of the intermediate transfer belt 61 is almost closed, and the heat transfer plate 68 almost extends all over the inner section of the intermediate transfer belt 61, temperature in the inner section almost kept constant avoiding unevenness depending on sections. Further, when only one heat generating member is used for a large intermediate transfer belt 61 and a large heat transfer plate 68, and as a result, a member cannot sufficiently keep temperature, or when calorie of one heat generating member 6 is insufficient for all of members, two or more heat generating members can be placed on the heat transfer plate 68. However, it is not preferable if a number of members necessitating the temperature keeping is as same as that of the heat generating members 69 or a number of the latter exceeds that of the former.

The plate like heat generating member 69 includes a self-temperature control function as discussed in the Japanese Patent Application Laid Open No. 3-288174 (e.g. Ceramac™). Specifically, as disclosed in the Japanese Patent Application Laid Open No. 9-96971, either when a main power supply is turned off or when an apparatus is not used for a prescribed time period and enters into a sleep mode in which a main power supply is turned off, a power source circuit separate from a control system for a body apparatus can operate the heat generating member. Further, as described in the Japanese Patent Application Laid Open No. 3-288174, power supply to the plate like heat generating member is controlled by a temperature detection element, such as thermister, etc.

Figure 6:
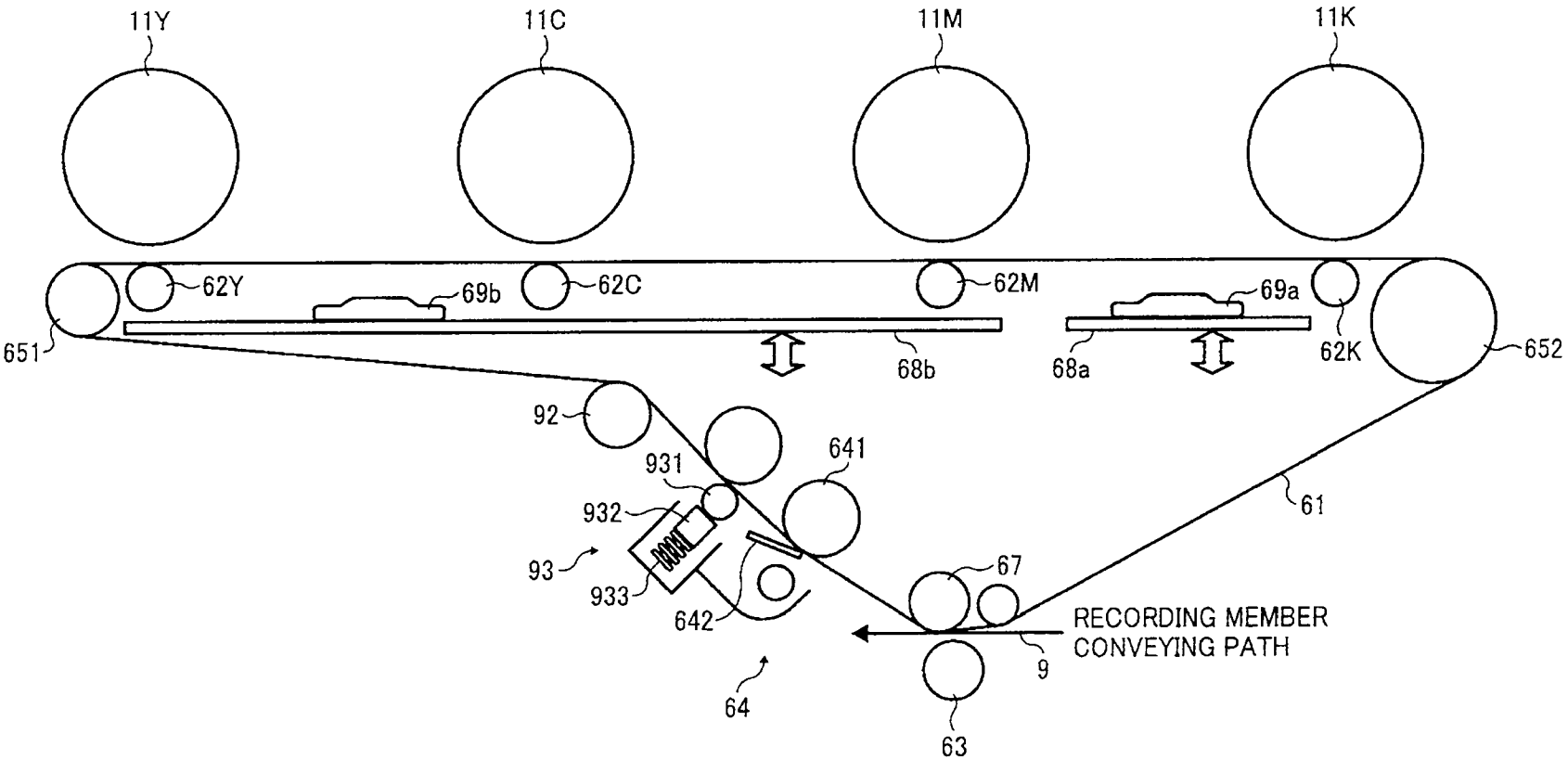
FIG. 6 is a chart schematically illustrating surroundings of the intermediate transfer belt included in the image forming apparatus according to another embodiment of the present invention.
Figure 7:
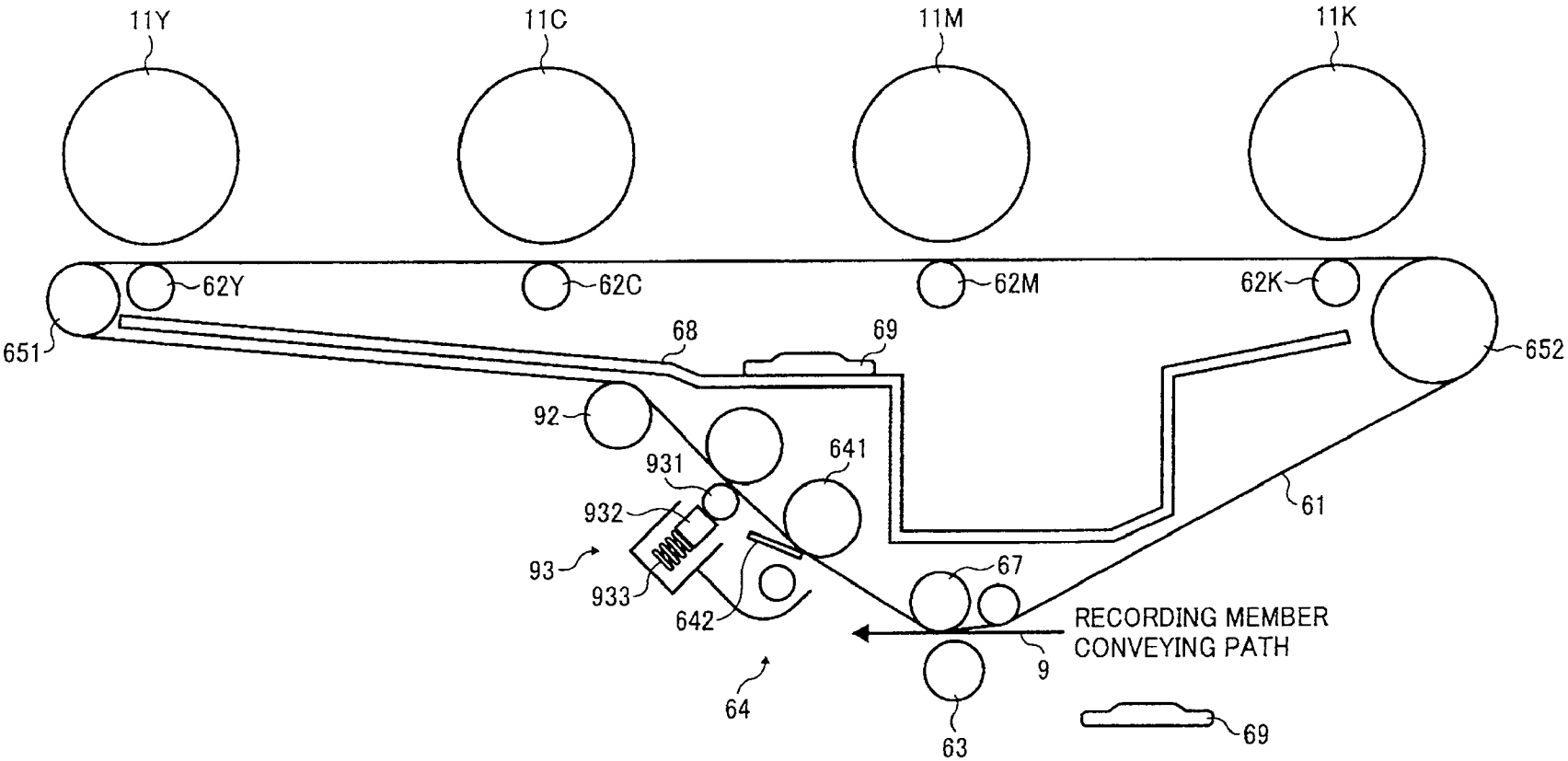
FIG. 7 is a chart schematically illustrating surroundings of the intermediate transfer belt included in a comparative image forming apparatus.
Figure 8:
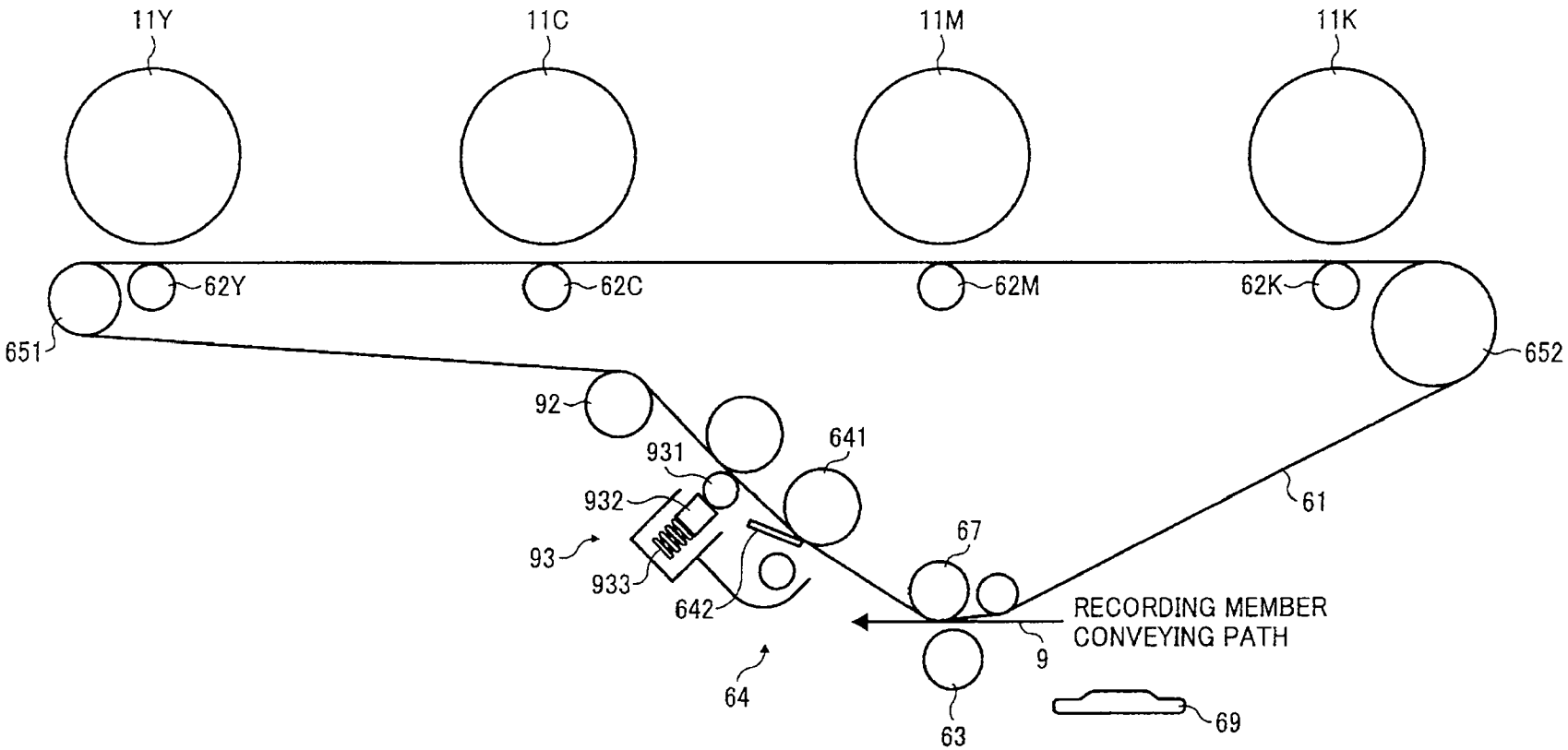
FIG. 8 is a chart schematically illustrating surroundings of the intermediate transfer belt included in a conventional image forming apparatus.

Now, the image forming apparatus shown in FIG. 2 is compared with that as shown in FIGS. 6 and 7. Similar to the image forming apparatus 1 of FIG. 2, the comparative image forming apparatus of FIG. 7 includes another heat generating member 69' arranged below the secondary transfer roller 63 beside the heat generating member 69 arranged in the vicinity to the primary transfer roller 62K. FIG. 8 illustrates a conventional image forming apparatus, in which the plate like heat generating member 69 is excluded, but the other heat generating member 69' is arranged below the secondary transfer roller 63 on the side of the primary transfer roller 62K. The plate like heat generating member 69 capable of outputting 60 W is prepared by covering a snaking nichrome wire with a heat resistant insulation tube and then wrapping it with an aluminum foil. The plate like heat generating member 69 is then arranged at a position as shown in FIG. 2. The plate like heat generating member 69 is then adhered to a structure member having a thickness of 1.6 mm made of aluminum and arranged inside the intermediate transfer belt 61 with adhesive of silicone. While distributing power to the heat generating member 69 until temperature of each of parts becomes constant, a difference of temperature between a parts and ambient atmosphere is detected and listed on the table 1. Similarly, in the image forming apparatuses of FIGS. 7 and 8, while distributing power to the heat generating member until temperature of each of parts becomes constant, a difference of temperature between a parts and ambient atmosphere is detected and listed on the table 1.

The table is illustrated in FIG. 12.

A secondary transfer power supply 91 is provided and is subjected to constant current control. A metal core of the secondary transfer roller 63 is grounded, while a metal core of the repelling force roller 67 is applied a bias voltage having the same polarity as toner. Specifically, a repelling force system is implemented. However, the repelling force roller 67 can be grounded while the secondary transfer roller 63 is applied a bias voltage of the different polarity to that of the toner. The repelling force roller 67 includes a metal core and a foam member made of copolymer arranged around the metal core. The foam member can include one of the NBR, ECO, PUR, and a mixture of these. For example, the foam member typically includes a single layer of foamed polymer of the NBR and ECO having a resistance as shown in the table 2. Further, the secondary transfer roller 63 of one embodiment of the present invention includes a metal core and a foam member made of copolymer arranged around the metal core. The copolymer can include the NBR, ECO, PUR, and mixture of those. Since contacting the printing medium or the like, the secondary transfer roller 63 can include a surface layer made of fluorine resin, silicone resin, or the like for the purpose of protection. For example, the secondary transfer roller 63 typically includes a resistant layer made of a copolymer member, such as NBR, ECO, etc., and a surface layer made of fluorine resin collectively having a resistance as shown in the table 2. A resistance of the repelling force roller 67 under room temperature of 23 centigrade/50% is 7.79 log ohm. That of the secondary transfer roller 63 is 6.73 log ohm. Thus, the resistance of the secondary transfer roller 63 is almost one tenth of that of the repelling force roller 67.

Table 2 is illustrated in FIG. 13A.

Further, when fitting in each of measurement environment, a repelling force roller 67 is placed on a metal flat plate grounded, and −50 microampere is distributed to the roller metal core from a constant current power supply. Then, a power supply voltage is measured. Then, voltages and resistances are calculated based on a relation between the voltage and −50 microampere using Ohm's law and are listed on the table 2, wherein the voltages are displayed by absolute values even negative values (i.e., minus). Similarly, when fitted in each of measurement environ, a secondary transfer roller 63 is placed on a metal flat plate grounded, and +50 microampere is distributed to the roller metal core from a constant current power supply. Then, a power supply voltage is measured. Then, voltages and resistances are calculated based on a relation between the voltage and +50 microampere using Ohm's law and are listed on table 2. The polarity of the voltage applied to the metal cores of the repelling force roller 67 and the secondary transfer roller 63 is changed in this way in order to equalize a direction of current actually flowing when the secondary transfer is executed with that flowing when the current is measured. As shown, electric resistance (Ohm) is represented by common logarithm (log) as displayed by symbol log Ω. When temperature of an apparatus is not kept even in a condition of 10 degree centigrade/15%, both of the roller and the secondary transfer roller 63 maintain the same condition (i.e., 10 degree centigrade 15%). Specifically, as shown in the table 2, the resistance of the repelling force roller 67 is 8.19 log Ω, while that of the secondary transfer roller 63 is 6.94 log Ω. When 50 microampere is distributed, voltages of the repelling force roller 67 and the secondary transfer roller 63 are 7.7 kV and 0.44 kV, respectively. A secondary transfer voltage generated by secondary transfer bias of 50 micro Ampere is 8.1 kV as the sum of the voltages of the repelling force roller 67 (i.e., 7.7 kV) and the secondary transfer roller 63 (0.44 kV).

Since voltages of the intermediate transfer belt 61 and the printing medium are further added to the sum, 8.1 kV is exceeded.

When temperature of an attaching section attaching the heat generating member is kept, temperature of the repelling force roller 67 becomes 19.1 degree centigrade and is almost 20 degree centigrade. Thus, since a water amount in air maintains 10 degree centigrade/15%, relative humidity is about 8%. Further, temperature of the secondary transfer roller 63 becomes 14.6 degree centigrade and is almost 15 degree centigrade. Thus, since a water amount in air maintains 10 degree centigrade/15%, relative humidity is about 11%. As shown, in the table 2, the resistance of the repelling force roller 67 is 7.92 log Ω in the condition of 20 degree centigrade/8%, while that of the secondary transfer roller 63 is 6.86 log Ω in the condition of 15 degree centigrade/11%.

When 50 microampere is distributed, voltages of the repelling force roller 67 and the secondary transfer roller 63 are 4.2 kV and 0.36 kV, respectively. A secondary transfer voltage generated by the secondary transfer bias of 50 micro Ampere is 4.5 kV as the sum of the voltages of the repelling force roller 67 (i.e., 4.2 kV) and the secondary transfer roller 63 (0.36 kV). Since the voltage of the printing medium is added to the sum, 4.5 kV is exceeded. Since temperature keeping in the vicinity of the intermediate transfer belt 61 is not linked with temperature and humidity of a printing medium, a voltage of the printing medium is the same. Thus, in comparison with a case of not keeping temperature, the secondary transfer voltage decrease by 3.6 kV as calculated by subtracting 4.5 kV from 8.1 kV, and thus decreases by 44% (i.e., 3.6 kV/8.1 kV) as a result of the temperature keeping.

Further, when temperature of an attaching section attaching the heat generating member 69 is kept, while resistances of the repelling force roller 67 and the secondary transfer roller 63 are opposite in a comparison example to those in the embodiment, the following result is obtained as shown in the table 3. Specifically, an electric resistance of the repelling force roller 67 is 6.78 log Ω in the condition of 20 degree centigrade/8%, whereas that of the secondary transfer roller 63 is 8.071 log Ω in the condition of 15 degree centigrade/11%. When 50 microampere is distributed, voltages of the repelling force roller 67 and the secondary transfer roller 63 are 0.30 kV and 5.9 kV, respectively. A secondary transfer voltage generated by the secondary transfer bias of 50 micro Ampere is 6.2 kV as the sum of the voltages of the repelling force roller 67 (i.e., 0.30 kV) and the secondary transfer roller 63 (5.9 kV). Since a voltage of a printing medium is further added to the sum, 6.2 kV is exceeded. Since temperature keeping in the vicinity of the intermediate transfer belt 61 is not linked with temperature and humidity of a printing medium, a voltage of the printing medium is the same. Thus, in comparison with a case of not keeping temperature, the second transfer voltage decrease by 1.9 kV as calculated by subtracting 6.2 kV from 8.1 kV, and thus decreases by 23% (i.e., 1.9 kV/8.1 kV) as a result of the temperature keeping. As recognized from the comparison of the above-mentioned embodiments with the comparative examples, when the resistance of the repelling force roller 67 is larger than that of the secondary transfer roller 63, increase of the secondary transfer voltage can be suppressed by about twice under the low temperature environment. Table 3 is illustrated in FIG. 13B.

Further, to efficiently reduce the secondary transfer voltage by temperature keeping even when an electric resistance of the secondary transfer roller 63 is high, heat generating member 69' is arranged in the vicinity of the secondary transfer roller 63 in addition to that 63 arranged inside the intermediate transfer belt 61, and comparison result is shown in the table 3. Specifically, power is kept supplied to the pair of heat generating members 69 and 69' so that temperature of each of parts becomes constant. Then, differences of temperature between the parts and ambient atmosphere are detected when the temperature becomes constant and resultant values are listed on the table 1. As shown, temperature keeping becomes further improved such that the secondary transfer roller 63 and the repelling force roller 67 are +13.0 degree centigrade and +14.8 degree centigrade, respectively. However, a difference of temperature between the primary transfer rollers M and Y increases to 13.8 degree centigrade, such as +20.9 degree centigrade and +7.1 degree centigrade, respectively. In one embodiment, their values are +16.6 degree centigrade and +5.9 degree centigrade, so that the difference becomes 10.6 degree centigrade. Even depending upon a type of toner, when temperature increases from 45 degree centigrade to 55 degree centigrade, the toner starts softening, and tends to cause clogging and filming. The temperature of the comparative photoconductive member 11M is +20.9 sdegree centigrade, and thus exceeds 45 degree centigrade when the ambient temperature is 25 degree centigrade. When temperature of the photoconductive member 11M is controlled by turning off the heat generating member not to exceed 45 degree centigrade, temperature of the primary transfer roller 62Y does not increase to +7.1 degree centigrade, resulting in short of temperature keeping effect. Further, when a heat generating member is provided to warm the primary transfer roller 62Y, such short of temperature keeping effect can be recovered.

However, the more the number of the heat generating members, the more disadvantage of an installation space and weight. Further, temperature of the photoconductive member 11M increases due to the primary transfer roller 62Y. Further, temperature of the cleaning belt backup roller 221 is +11.7 degree centigrade as shown in the table 1, and does not reach the level where toner is softened even in the ambient temperature. Thus, the toner on the intermediate transfer belt 61 is melted, and cleaning is preferably executed avoiding cleaning malfunction. Further, since temperature of the cleaning belt backup roller 221 is almost constant, a cleaning condition can be widely designated, whereby cleaning can be appropriately executed for a long time. Accordingly, it is most advantageous that a heat generating member 69 is arranged inside an intermediate transfer belt 61 and uniformly warms various parts arranged around the intermediate transfer belt 61 by utilizing an almost closed space created by the intermediate transfer belt 61.

When temperature of image formation sections of the developing device 30, the photoconductive members 11Y to 11K, and the intermediate transfer belt 94 excessively increase, the toner starts softened resulting in poor images. Although depending on a type of toner, when temperature is not less than 92 degree centigrade (sometime not less than 45 degree centigrade), a normal image formation become impossible. Then, some devices are needed to control temperature in the image forming apparatus 1. As a method of controlling temperature of the image forming apparatus 1, methods 1 to 3 illustrated in FIGS. 9 to 11, respectively, are exemplified. In the first method of FIG. 9, a main switch 94 includes a mechanism to created one of conditions where a terminal 941 on the side of an outlet 95 is connected and disconnected to a terminal 943 in turn on and off conditions as displayed, respectively. To the terminal 942, a power supply 971 that supplies power to a control board 96 that generally controls the image forming apparatus 1 and a power supply 972 that supplies power to a fixing device 70 are connected. The terminal 943 is connected to a temperature keeping heater 99 via a temperature keeping switch 38. Now, respective conditions of the image forming apparatus when the main switch 94 and the temperature keeping switch 98 are turned on and off are described. When the main switch 94 and the temperature keeping switch 98 are all turned off, the image forming apparatus 1 and the temperature keeping heater 99 do not become an operative condition. Thus, when temperature around the image forming apparatus 1 becomes low, temperature of parts as temperature keeping targets in the image forming apparatus is not kept. Then, when the main switch 94 is turned on, and the image forming apparatus becomes possible to operate, a problem occurs in the image forming apparatus 1 due to increase of resistance of the parts as temperature keeping targets or the like even if the image forming apparatus 1 becomes possible to operate, because the temperature of the parts are still low. Then, the temperature keeping switch 98 includes a function to selectively execute temperature keeping to avoid generation of power needed for the temperature keeping in preference to resolving the above-mentioned problem.

When the main switch 94 is turned off while the temperature keeping switch 98 is turned on, the temperature keeping heater 99 is connected to the outlet 95 and starts keeping temperature. Thus, even when temperature around the image forming apparatus 1 becomes low, temperature of the parts as temperature keeping targets is kept. Then, when the main switch 94 is turned on and thereby the image forming apparatus 1 becomes possible to operate, the above-mentioned problem does occur in the image forming apparatus 1, because the temperature of the parts are kept. Then, when the main switch 94 is turned on, the temperature keeping heater 99 is cut off from the outlet 95. Since the fixing heater and the temperature keeping heater do not heat simultaneously, excessive increase of the temperature can be also avoided in the image forming apparatus 1. As a result, softening of the toner or the like can be avoided. Various parts 101, such as a fixing temperature sensor 72, plural motors, plural high voltage power supplies, plural sensors, etc., controlled by the control board are illustrated in FIG. 9.

Now, a second temperature control method using a self-control heat generating member 102 as a temperature keeping heater 99 is described with reference to FIG. 10. The self-control heat generating member 102 starts generating heat until a prescribed level and stops generating the heat at the level to maintain the temperature within a prescribed range. As shown, the self-control heat generating member 102 includes a heat generating member 103 constituted by wiring a nichrome line covered with a heat resistant insulation tube in a snake state and wrapping it with aluminum foil. Also included is a bimetallic element 104 arranged contacting the aluminum foil. Power to the nichrome line is supplied via the bimetallic element 104. Thus, when temperature of the bimetal 104 becomes more than a prescribed level, the bimetal 104 is cut off, while contact each other when it is less than the prescribed level. Due to contact with the aluminum foil that wraps the nichrome line covered with the heat resistant insulation tube, the bimetal 104 maintains temperature of the aluminum foil constant. Further, a temperature keeping switch 98 is provided independently from the main switch 94. Thus, when the temperature keeping switch 98 is turned on regardless of the operation of the main switch 94, since temperature of the heat generating member 103 is kept within a prescribed range, parts as temperature keeping targets are also kept in the prescribed range. Thus, the temperature keeping switch 98 has a function to selectively execute the temperature keeping to avoid generation of power needed for the temperature keeping in preference to resolving the above-mentioned problem.

Now, a third temperature control method using a temperature keeping switch 98 separate from a main switch 94 is described with reference to FIG. 11. Specifically, as shown, a power supply for supplying power to a temperature keeping private use control board 105 is provided independent from the entire image forming apparatus 1. A temperature keeping switch 98 is also provided independent from a main switch 94. Thus, when the temperature keeping switch 98 is turned on regardless of the operation of the main switch 94, since temperature of the temperature keeping heater 99 is kept within a prescribed range, parts as temperature keeping targets is also kept within the prescribed range. Thus, the temperature keeping switch 98 to selectively execute the temperature keeping to avoid generation of power needed for the temperature keeping in preference to resolving the above-mentioned problem. 106 denote a temperature and humidity keeping sensor in FIG. 11.

Now, an exemplary operation of a full color image formation with the above-mentioned configuration is described. The image forming apparatus 1 includes an automatic document feeder 5 that automatically conveys an original document, a scanner section 4 that reads an image on the original document, an image formation section 3 having a process cartridge 10 serving as an image formation unit for forming an image, and a sheet feeding section 2 having a sheet feeding cassette 81 accommodating printing mediums and the like. The scanner section 4 includes a contact glass for setting the original document, a reference plate arranged at a prescribed position for placing the original document, and an optical scanning system. The optical scanning system includes an exposure lamp, such as a xenon lamp, etc., first to third mirrors, an imaging lens, and a reading having a full color-CCD. The original document on the contact glass is scanned and imaging thereof is executed on a light receiving surface of the reading sensor by the lens, so that photoelectric conversion is executed. Image signals separated into respective mono colors of red, green, and blue by the full color reading sensor are subjected to A/D conversion by an image processing circuit. The converted signals are then subjected to various images processing in an image processing section, not shown. The image forming apparatus 1 starts preparation of image formation by an operation of a switch, not shown. At this moment, the heat generating member 69 is supplied with power and generates heat. Because, when the heat generating member 69 starts generating heat and the image forming apparatus 1 starts image formation, it takes long time to organize environment, such as temperature of the inside of the intermediate transfer belt 61, etc. and accordingly, a high quality image is not obtained.

The image formation starts with formation of latent images of mono colors on the surfaces of the respective photoconductive members 11 with negative polarity by emitting a laser beam of the exposure device 12. Then, the developing devices 40 execute reverse development by applying toner of prescribed colors having the same polarity to that of charge on the photoconductive member 11 to visualize the latent images. At this moment, the endless intermediate transfer belt 61 is arranged above the photoconductive members 11Y to 11K being supported by plural rollers 651 to 653 and traveling partially contacting the photoconductive members 11Y to 11K at their post development sections. Further, the toner images formed on the photoconductive members 11Y to 11K are transferred and superimposed onto the intermediate transfer belt 61 by the primary transfer rollers 62Y to 62K, respectively, thereby a not fixed full color image is formed. Around the outer circumferential section of the intermediate transfer belt 61, there is provided a belt cleaning device 64 opposing the roller 641 to remove needless toner and alien substance, such as paper dust, etc., remaining on the surface of the intermediate transfer belt 61. Further provided around the outer circumferential section of the intermediate transfer belt 61 is a secondary transfer roller 63 opposing the repelling force roller 67 serving as a facing member. Thus, by applying a bias to the second transfer roller 63 and the repelling force roller 67 while conveying the printing medium 9 between the intermediate transfer belt 61 and the secondary transfer roller 63, the toner image on the intermediate transfer belt 61 is transferred onto the printing medium 9. At this moment, by previously controlling temperature of the primary transfer roller 62, the secondary transfer roller 63 and the repelling force roller 67 to be a constant level, disturbance of an image can be suppressed while increasing transfer efficiency at a wide range on a transfer nip section. As a result, a high quality image can be transferred onto the printing medium 9.

Polarity of the transfer voltage applied to the secondary transfer roller 63 is positive as opposite to that of the toner.

Various members linked with the intermediate transfer belt 61 are integrally formed with the intermediate transfer belt 61 as a transfer device 60 to be detachable to and from the image forming apparatus 1. Below the image forming apparatus 1, there is provided a sheet feeding device 80 having a sheet feeding cassette 81 accommodating printing mediums and capable of launching thereof. Specifically, only one printing medium 9 is credibly fed toward a registration roller 84 from the sheet feeding cassette 81 by a conveyance roller 82. Further, the printing medium 9 having passed the secondary transfer roller 63 is further conveyed to the fixing device 70 downstream thereof. The printing medium 9 is subjected to fixing and is ejected and stacked on a sheet ejection tray arranged outside the image forming apparatus 1 by a sheet ejection roller 85. Thus, an image is rarely disturbed during a transfer process while improving transfer efficiency. As a result, high density and quality image can be obtained.

Obviously, numerous additional modifications and variations of the present invention are possible in light of the above teachings. It is therefore to be understood that within the scope of the appended claims, the present invention may be practiced otherwise than as specifically described herein.

ADVANTAGE

According to one embodiment of the present invention, heat interruption can be suppressed at low cost without a space.

Further, temperature decrease caused by leakage of heat can be suppressed.

What is claimed is:

1. An image forming apparatus, comprising:

at least two image bearers configured to carry toner images;

an endless intermediate transfer member rotating in a prescribed direction;

at least two semiconductive primary transfer members arranged inside the intermediate transfer member opposing the at least two image bearers, said at least two semiconductive primary transfer members transferring and superimposing the toner images on the endless intermediate transfer member in a primary transfer in a primary electric field created between the at least two image bearers and the at least two semiconductive primary transfer members, respectively;

a facing member arranged inside the intermediate transfer member, a secondary transfer member configured to execute a secondary transfer from the intermediate transfer member to a printing medium in a secondary electric field created between the printing medium and the secondary transfer member;

a heat generating member arranged inside the intermediate transfer member and configured to generate heat, and a heat transfer member that is nonrotatable inside the intermediate transfer member and configured to transfer the heat generated by the heat generating member to the at least two semiconductive primary transfer members by either approximating contact with or contacting the at least two semiconductive primary transfer members.

2. The image forming apparatus as claimed in claim 1, wherein said at least two image bearers are arranged laterally, and wherein said heat transfer member is arranged below the at least two semiconductive primary transfer members.

3. The image forming apparatus as claimed in claim 2, further comprising at least two heat shielding side plates configured to substantially close an inner space of the intermediate transfer member.

4. An image forming apparatus, comprising:

at least two image bearers configured to carry toner images;

an endless intermediate transfer member rotating in a prescribed direction;

at least two semiconductive primary transfer members arranged inside the intermediate transfer member opposing the at least two image bearers, said at least two semiconductive primary transfer members transferring and superimposing the toner images on the endless intermediate transfer member in a primary transfer in a primary electric field created between the at least two image bearers and the at least two semiconductive primary transfer members, respectively;

a facing member arranged inside the intermediate transfer member, a secondary transfer member configured to execute a secondary transfer from the intermediate transfer member to a printing medium in a secondary electric field created between the printing medium and the secondary transfer member;

a heat generating member arranged inside the intermediate transfer member and configured to generate heat, and a heat transfer member that is nonrotatable inside the intermediate transfer member and configured to transfer the heat generated by the heat generating member to the facing member by either approximating contact with or contacting the facing member;

wherein said secondary electric field is created by differentiating voltages of the secondary transfer member and the facing member from each other; and wherein electric resistance of the secondary transfer member is smaller than that of the facing member.

5. The image forming apparatus as claimed in claim 4, wherein said facing member is arranged below the heat transfer member, and wherein said heat generating member either approximates contact with or contacts the facing member.

6. The image forming apparatus as claimed in claim 5, further comprising:

a cleaning member configured to remove toner on the intermediate transfer member; and a cleaning backup member internally contacting the intermediate transfer member opposing the cleaning member;

wherein said heat transfer member transfers the heat to the cleaning backup member by either approximating contact with or contacting the cleaning backup member.

7. The image forming apparatus as claimed in claim 6, wherein said cleaning backup member is arranged below the heat transfer member, said heat generating member is arranged to either approximate contact with or contact the cleaning backup member.

8. The image forming apparatus as claimed in claim 6, further comprising at least two heat shielding side plates configured to substantially close an inner space of the intermediate transfer member.

9. An image forming apparatus, comprising:

at least two image bearers configured to carry toner images;

an endless printing medium conveying member;

at least two semiconductive transfer members internally contacting the printing medium conveying member and configured to transfer and superimpose the toner images on the at least two image bearers to a printing medium;

a heat generating member arranged inside the endless printing medium conveying member and configured to generate heat, and a heat transfer member that is nonrotatable inside the endless printing medium conveying member and configured to transfer the heat generated to the at least two semiconductive transfer members.

10. The image forming apparatus as claimed in claim 9, wherein said at least two image bearers are arranged laterally, and wherein said heat transfer member is arranged below the at least two transfer member.

11. The image forming apparatus as claimed in claim 10, further comprising:

a cleaning member configured to remove toner on the printing medium conveying member; and a cleaning backup member internally contacting the printing medium conveying member opposing the cleaning member;

wherein said heat generating member transfers the heat to the cleaning backup member by either approximating contact with or contacting the cleaning backup member.

12. The image forming apparatus as claimed in claim 11, further comprising at least two heat shielding side plates configured to substantially close an inner space of the printing medium conveying member.

13. The image forming apparatus as claimed in claim 1, wherein the heat transfer member includes a flat surface facing the at least two semiconductive transfer members.

14. The image forming apparatus as claimed in claim 4, wherein the heat transfer member includes a flat surface facing the at least two semiconductive transfer members.

15. The image forming apparatus as claimed in claim 9, wherein the heat transfer member includes a flat surface facing the at least two semiconductive transfer members.

16. The image forming apparatus as claimed in claim 1, wherein the heat transfer member includes an angle protruding toward the facing member.

17. The image forming apparatus as claimed in claim 4, wherein the heat transfer member includes an angle protruding toward the facing member.

18. An image forming apparatus, comprising:

at least two image bearers configured to carry toner images;

an endless intermediate transfer member rotating in a prescribed direction;

at least two semiconductive primary transfer members arranged inside the intermediate transfer member opposing the at least two image bearers, said at least two semiconductive primary transfer members transferring and superimposing the toner images on the endless intermediate transfer member in a primary transfer in a primary electric field created between the at least two image bearers and the at least two semiconductive primary transfer members, respectively;

a secondary transfer member configured to execute a secondary transfer from the intermediate transfer member to a printing medium in a secondary electric field created between the printing medium and the secondary transfer member;

a heat generating member arranged inside the intermediate transfer member and configured to generate heat, and a plate member that is made of metal and that is nonrotatable inside the intermediate transfer member and that is arranged below the heat generating member, the plate member extending horizontally from a position of the heat generating member to a position below the at least two semiconductive primary transfer members.

19. The image forming apparatus as claimed in claim 18, wherein said at least two image bearers are arranged laterally.

20. The image forming apparatus as claimed in claim 18, wherein the heat generating member is disposed horizontally between said at least two semiconductive primary transfer members.

21. The image forming apparatus as claimed in claim 18, wherein said at least two semiconductive primary transfer members include ion conduction material.

22. The image forming apparatus as claimed in claim 18, wherein said at least two semiconductive primary transfer members include inorganic conductive material.

23. The image forming apparatus as claimed in claim 18, wherein the heat generating member contacts the plate member.

24. The image forming apparatus as claimed in claim 18, wherein a thickness of the plate member is from about 0.6 to about 3 mm.

25. The image forming apparatus as claimed in claim 18, wherein the metal includes at least one of copper, aluminum, and iron.

26. The image forming apparatus as claimed in claim 18, further comprising at least two heat shielding side plates configured to substantially close an inner space of the intermediate transfer member.

27. The image forming apparatus as claimed in claim 26, wherein the plate member supports the at least two heat shielding side plates.

* * * * *